US008771154B2

(12) United States Patent
Fedriga

(10) Patent No.: US 8,771,154 B2
(45) Date of Patent: Jul. 8, 2014

(54) GYMNASTIC EQUIPMENT

(75) Inventor: Mario Fedriga, Forli (IT)

(73) Assignee: Technogym S.p.A., Gambettola (FC) (IT)

( * ) Notice: Subject to any disclaimer, the term of this patent is extended or adjusted under 35 U.S.C. 154(b) by 538 days.

(21) Appl. No.: 13/084,626

(22) Filed: Apr. 12, 2011

(65) Prior Publication Data

US 2011/0251023 A1 Oct. 13, 2011

(30) Foreign Application Priority Data

Apr. 13, 2010 (IT) ..... RA2010A0009

(51) Int. Cl.
*A63B 21/045* (2006.01)

(52) U.S. Cl.
USPC ..... 482/122; 482/129

(58) Field of Classification Search
USPC ..... 482/121–130, 148, 907, 92, 91
See application file for complete search history.

(56) References Cited

U.S. PATENT DOCUMENTS

| | | | | | |
|---|---|---|---|---|---|
| 1,564,089 | A * | 12/1925 | Maxwell | 124/24.1 |
| 2,763,156 | A * | 9/1956 | Garigal | 73/379.08 |
| 4,334,678 | A | 6/1982 | Doyel | |
| 4,612,907 | A * | 9/1986 | Gantt | 124/35.2 |
| 5,065,730 | A * | 11/1991 | Kluver | 124/35.2 |
| 5,353,780 | A * | 10/1994 | Carella | 124/86 |
| 5,478,068 | A | 12/1995 | Schroeder | |
| 6,425,765 | B1 * | 7/2002 | Irwin, III | 434/247 |
| 6,457,685 | B1 * | 10/2002 | Taylor | 248/166 |
| 6,663,059 | B1 * | 12/2003 | Warren | 248/156 |
| 7,250,022 | B2 * | 7/2007 | Dalebout et al. | 482/142 |
| 7,434,773 | B1 * | 10/2008 | Minjares | 248/181.1 |
| 8,079,942 | B2 * | 12/2011 | Anderson | 482/121 |
| 2003/0232707 | A1 | 12/2003 | Dalebout | |

FOREIGN PATENT DOCUMENTS

| | | | |
|---|---|---|---|
| CN | 201 049 169 | Y | 4/2008 |
| DE | 82 23 741 | U1 | 3/1992 |
| EP | 1 402 925 | A1 | 3/2004 |
| WO | WO 2008/046455 | A1 | 4/2008 |

OTHER PUBLICATIONS

European Search Report dated Dec. 1, 2010.
Extended European Search Report dated Sep. 6, 2011.

* cited by examiner

*Primary Examiner* — Stephen Crow
(74) *Attorney, Agent, or Firm* — Abelman, Frayne & Schwab

(57) ABSTRACT

A gymnastic equipment (1) comprising a frame (10), a load group (20) carried by the frame (10) in a given manner; the load group (20) comprising an elongated elastic body (30) connected to the frame (10) and a flexible member (40) connected to the elastic body (30) in a given manner; the elastic body (30) comprising an arch (30) delimited by two respective end portions (32) (33), each of which being designed to couple with the flexible member (30) in such a manner as to maintain this latter tensioned both at rest and in use, during the execution of a training exercise.

19 Claims, 4 Drawing Sheets

Fig. 1
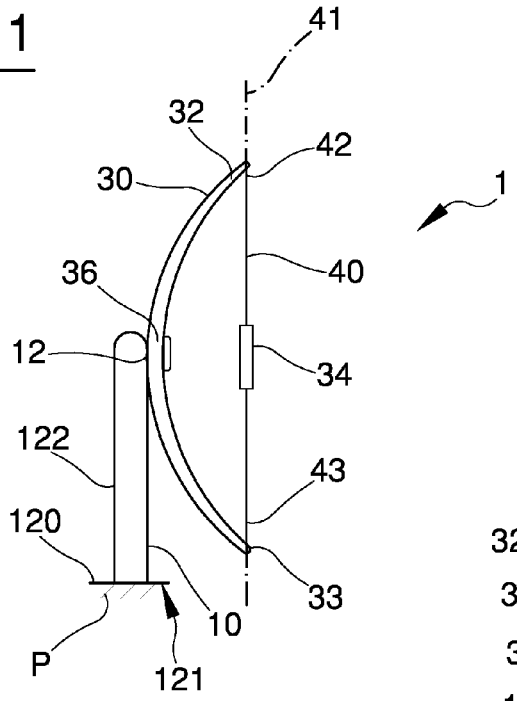
Fig. 2
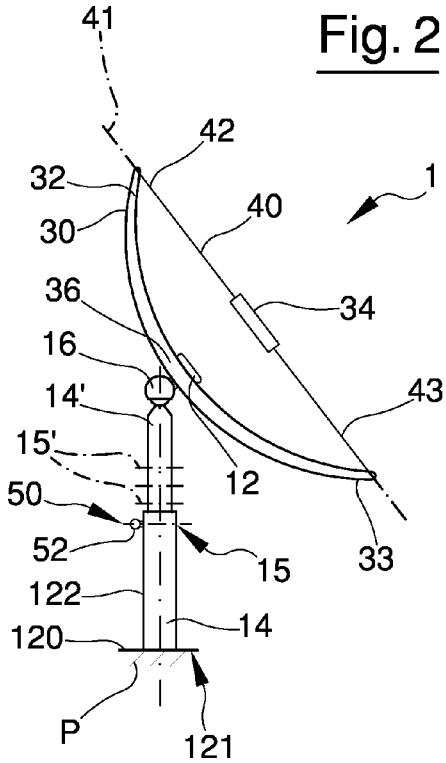
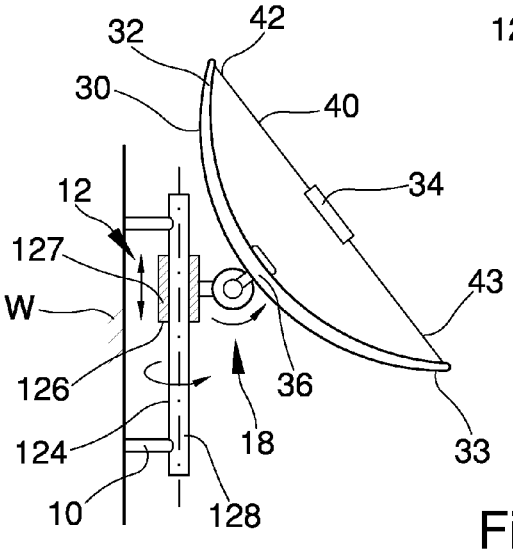
Fig. 3

GYMNASTIC EQUIPMENT

FIELD OF THE INVENTION

The present invention relates to a gymnastic equipment. In particular, the present invention relates to a gymnastic equipment validly usable for executing functional exercises. In more detail, the present invention relates to a gymnastic equipment, validly usable for executing functional exercises, with minimum bulk and contained mass, suitable for outdoor use and use in brackish environments.

BACKGROUND TO THE INVENTION

In the field of gymnastic machines the use is well known of equipment provided with a load group provided with a weight stack of adjustable mass, which can be actuated with a substantially vertical alternating motion through a flexible member, usually an adequately dimensioned cable or tape. The cable/tape presents a first end portion coupled to a coupling member of the weight stack and a further end portion coupled to an implement, which can be a pulldown bar in the case of a so-called lat machine, or a handle in the case of a cable crossover machine. In other cases the implement is associated to the cable in an intermediate position, as in the case of the functional machines of the "Kinesis" line of the same Applicant, whose teachings are protected under the European patent EP 1402925.

It is easy to understand that machines of this type require a great care of the parts in relative movement, such as, by way of non-limiting example, the guide of the rectilinear motion to which slides are coupled provided with ball sleeves carrying the weight stacks, which can present considerable mass, and also the return pulleys for the cables. This entails the need for producing machines that are very complex regarding their components and therefore highly expensive, and requires high commitment in maintenance due to the need to maintain the parts in reciprocal movement able to slide in an optimum manner. Machines as those mentioned above are therefore not particularly suitable for outdoor use, and especially for installation on boats or in marine environments, where they could be particularly exposed to moist and brackish airstreams, which accelerate corrosion. These weight stack machines are furthermore accompanied by a great drawback, linked to the considerable entity of the load stressing the floor, which makes it difficult to install them in buildings or boats not designed for this purpose.

However, the demand for machines for executing functional exercises is significantly increasing not only by people without great resources for buying a new house or boat or for making structural changes to their old ones, but also by people desiring to give attendees a gymnastic equipment safe and easy to be used, even if their gym is located in a marine environment.

In view of the above description, the problem of having available a functional machine, which is easy to use, requires limited maintenance and lasts, independently of its collocation, is currently unsolved and represents an interesting challenge for the Applicant, who believes it could take advantage over the competitors by satisfying a niche market interested in executing functional exercises but currently penalised due to what described above.

In view of the situation described above, it would be desirable to have available a gymnastic equipment which, in addition to enabling to limit and possibly to overcome the typical drawbacks of the prior art illustrated above, could define a new standard for these types of devices for functional training

SUMMARY OF THE PRESENT INVENTION

The present invention relates to a gymnastic equipment. In particular, the present invention relates to a gymnastic equipment validly usable for executing functional exercises. In more detail, the present invention relates to a gymnastic equipment, validly usable for executing functional exercises, with minimum bulk and contained mass, suitable for outdoor use and use in brackish environments.

The object of the present invention is to provide a gymnastic equipment which allows the disadvantages described above to be solved, and which is suitable to satisfy a plurality of requirements that to date have still not been addressed, and therefore suitable to represent a new and original source of economic interest, capable of modifying the current market of the gymnastic equipment.

According to the present invention, a gymnastic equipment is provided, whose main characteristics will be described in at least one of the appended claims.

BRIEF DESCRIPTION OF DRAWINGS

Further characteristics and advantages of the gymnastic equipment according to the present invention will be more apparent from the description below, set forth with reference to the accompanying drawings, which illustrate some non-limiting examples of embodiment, in which identical or corresponding parts of the equipment are identified by the same reference numbers. In particular:

FIG. 1 is a side elevation view of a first preferred embodiment of the present invention;

FIG. 2 is a side elevation view of a second preferred embodiment of FIG. 1;

FIG. 3 is a side elevation view of a third preferred embodiment of FIG. 1;

DETAILED DESCRIPTION OF THE PRESENT INVENTION

Figure 4:
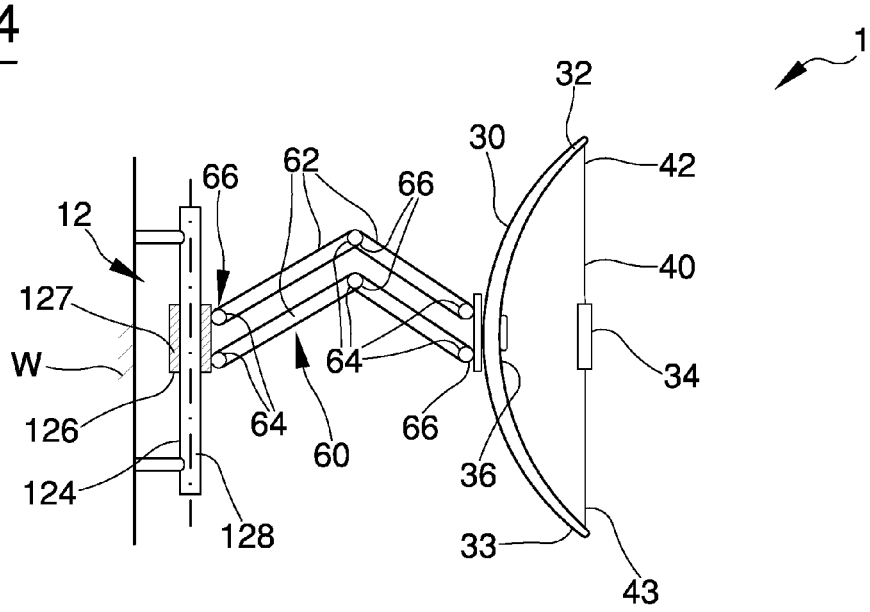
FIG. 4 is a side elevation view of a fourth preferred embodiment of FIG. 1.

In FIG. 1 number 1 indicates, in its entirety, a gymnastic equipment validly usable for executing functional exercises. The equipment 1 comprises a frame 10, a load group 20 carried by the frame 10 in a given manner and comprising an elongated elastic body 30 connected to the frame 10 and a substantially non extendable flexible member 40 connected to the elastic body 30 in a given manner. The elastic body 30 comprises in particular an arch-shaped body 30, that hereafter, for the sake of practicality, will be indicated only with the term "arch" if not otherwise specified. This arch 30 is delimited by two respective end portions 32 and 33, each of which is designed to couple with the flexible member 40 through respective first and second ends 42 and 43, in such a manner as to maintain the flexible member 40 tensioned both at rest and in use, during the execution of a training exercise. The flexible member 40 can be obviously actuated by means of a textile cable 40 or a tape, according to the clients' requirements. The flexible member will be indicated hereafter, for the sake of practicality, with the term cable 40, without however limiting the scope of the present invention.

The load group 20 furthermore comprises a handle member 34 associated with the cable 40 to facilitate the gripping thereof according to a direction transverse to a longitudinal axis 41 of the cable 40, so as to facilitate the application of a tensile stress to the elastic body 30 and, therefore, to execute a training exercise.

The arch 30 presents a respective intermediate portion 36, which is substantially equidistant from the respective end portions 32 and 33 and is designed to couple with the frame 10, and the frame 10 presents, in turn, a coupling unit 12 designed to couple with the intermediate portion 36. In this regard, the coupling unit 12 furthermore comprises a base 120 shaped so as rigidly to couple to a fixed body. This base presents, at least in FIG. 1, a substantially plane surface portion 121, designed to be coupled stably to a wall W or a floor P. With reference to FIGS. 1 and 2, the coupling unit 12 furthermore comprises a rod 122 extending from the base 120 and oriented in a given manner relative to this latter. In the variant of FIG. 2 this rod 122 is telescopic so as to allow the adjustment of a respective longitudinal extension thereof and thus to make the arch 30 usable by users of different height. The rod 122 of FIG. 2 comprises at least one first element 14 and one second element 14', which are elongated and coupled to each other, and comprises a blocking device 50 designed to fix a longitudinal extension of the rod 122. In this regard, the blocking device 50 presents a first hole 15 and a plurality of second holes 15', obtained respectively in the first element 14 and in the second element 14'; The first hole 15 and the second holes 15' are oriented transversally to the rod 122, and the blocking device 50 comprises at least a first pin 52, suitable to engage the transverse first and second holes 15 and 15' to fix to each other in axial direction the first element 14 and the second element 14'.

Again with reference to FIG. 2, the arch 30 can be connected to the rod 122 through the interposition of a first joint 16, designed to allow transverse movements of the arch 30 relative to the rod 122. This first joint 16 can be indifferently spherical or rotoidal, according to the user's requirements, and it can be therefore shaped in a known and not illustrated manner in both the configurations.

The use of the gymnastic equipment 1 is easily understood from what described and illustrated in FIGS. 1 and 2, and therefore requires no further explanations.

Lastly, it is apparent that modifications and variants can be made to the gymnastic equipment 1 described and illustrated herein, without however departing from the protective scope of the present invention.

For instance, with particular reference to FIG. 3, the coupling unit 12 furthermore comprises a guiding member 124, coupled rigidly to the wall W, and a slide 126. The guiding member 124 and the slide 126 are prismatically coupled to each other, and the arch 30 is connected to the slide 126 to allow to orient the arch 30 at will along the guiding member 124, so as to allow the user to pull the handle 34 according to a direction instantaneously definable at will, i.e. to actuate the handle 34 on a trajectory definable at will. Again with reference to FIG. 3, the arch 30 is connected to the slide 126 through the interposition of a second joint 18 designed to allow transverse movements of the arch 30 relative to the guiding member 124.

In this case the guiding member 124 comprises at least one elongated cylindrical body 128, oriented according to a given direction D; the slide 126 furthermore comprises a sleeve 127 coupled to the cylindrical body 128 in a freely rotatable manner, to rotate, in use, the arch 30 relative to the cylindrical body 128.

With particular reference to FIG. 4, the coupling unit 12 furthermore comprises a four bar linkage 60 arranged between the arch 30 and the guiding member 124/sleeve 127 to adjust a distance between the arch 30 and the guiding member 124. The four bar linkage 60 presents a plurality of levers 62, each of which is alternatively coupled to the slide 126, or to another lever 62 in a rotatable manner, through a rotoidal pair 64; at least one rotoidal pair 64 presents a blocking unit 66, designed stably to fix at will an inclination of a lever 62 relative to the slide 126, or of two levers 62 coupled to each other in a rotatable manner. If it is deemed adequate, at least one of the blocking units 66 can comprise an elastic member 68 suitable to exert an adjustable elastic strength which, in use, could act against a relative movement of the corresponding coupled members, or it could comprise a vice-like device, known to those skilled in the art and therefore not illustrated, provided with a jaw suitable to tighten in a close manner two adjacent levers 62, or a lever 62 and the corresponding coupling portion of the slide 126 or of the arch 30, to fix them temporarily in an angularly stable manner.

Figure 5:
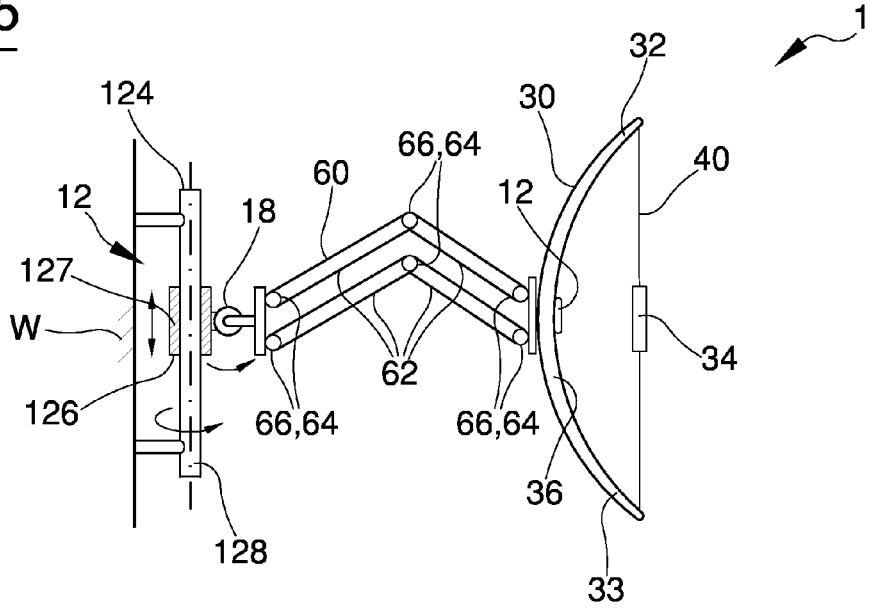
FIG. 5 is a side elevation view of a fifth preferred embodiment of FIG. 1.

With particular reference to the version of FIG. 5, the second joint 18 can be spherical but, due to the particular structural combination, synthesising in the sleeve 127 a circular freedom degree, it could be more validly of the rotoidal type, with a respective fulcrum axis oriented transversally to that of the sleeve 127. The sleeve 127 and the cylindrical body 128 are, in particular, coupled to each other in an freely axially slidable and freely rotatable manner.

Figure 6:
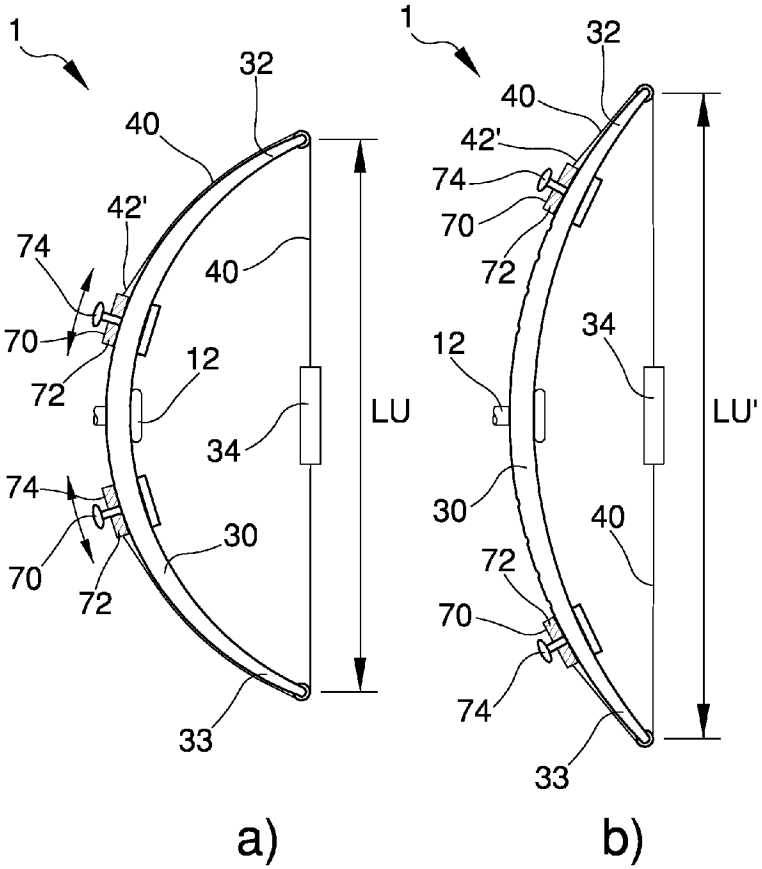
FIG. 6 is a side elevation view of a sixth preferred embodiment of FIG. 1.

In addition, with reference to FIG. 6*a*, it should be specified that the cable 40 presents a respective useful length LU of given extension between the end portions 32 and 33 and, as it can be changed in the updated value LU' as in FIG. 6*b*, it is possible to vary the entity of the tensile strength exerted by the arch 30, due to obvious reasons linked to the nature of the elastic force, that in this case would be lower.

Again with reference to what illustrated in FIGS. 6*a* and 6*b*, the cable 40 can present a respective third end 42' connected to the arch 30 in a slidable manner between the first and second end portions 32 and 33 through a regulating member 70 provided with a carriage 72 coupled to the arch 30 in a freely slidable and selectively transversally blockable manner through a screw 74 suitable to create a friction condition between the carriage 72 and the arch 30 or through a known an not illustrated pin suitable to engage a transverse hole of a plurality of known and not illustrated holes, obtained transversally in the arch 30, to allow to vary at will the extension of the useful length LU of the cable 40 and the entity of the load acting on the handle 34. This type of coupling between the end 42' and the body of the arch 30 can be obviously obtained also for the fourth end 43', remaining always possible to fix the fourth end 43' to the remaining free end portion 32 or 33 of the arch 30.

Figure 7:
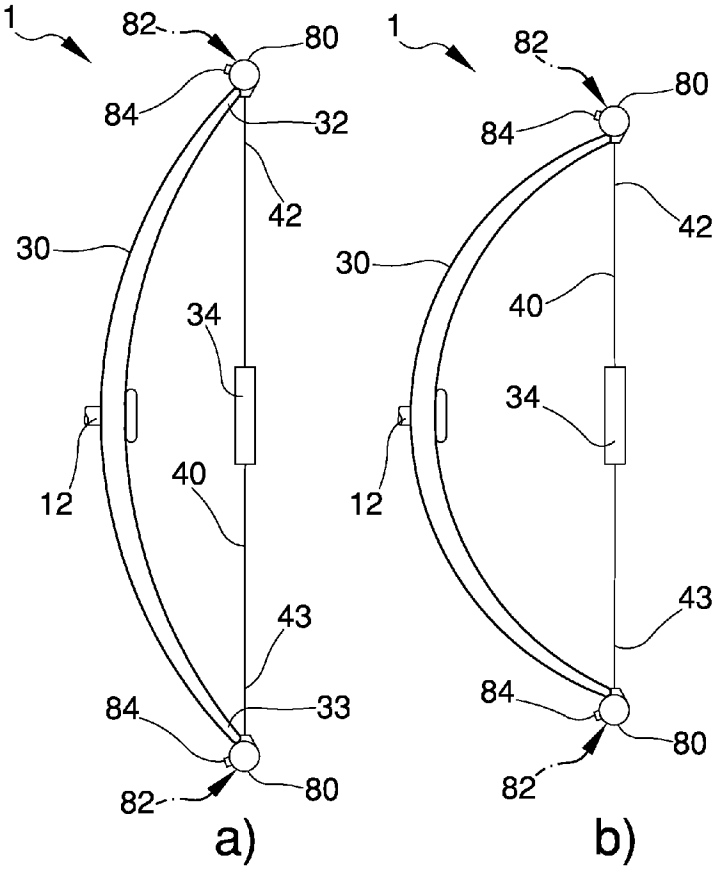
FIG. 7 is a side elevation view of a seventh preferred embodiment of FIG. 1.

In addition, to facilitate fixing to the arch 30 a useful length LU of the cable 40, it could be provide for using winders 80 known and illustrated only schematically in FIG. 7, as they are substantially identical to those with which the retractable leashes for tame animals are made. The known characteristic of these winders 80 is to be provided with a blocking device 82, which can be selectively actuated through a button 84, to vary very quickly, at will, the extension of the useful length LU of the cable 40, and thus the entity of the load acting on the handle 34.

Figure 8:
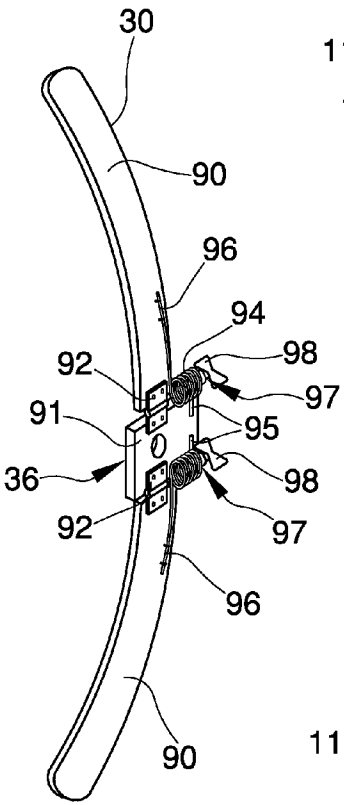
FIG. 8 is a schematic perspective view of an eighth preferred embodiment of a portion of FIG. 1 in enlarged scale and with some parts removed for the sake of clarity.

With reference to FIG. 8, the gymnastic equipment 1 is modified so that the arch 30 presents a pair of arms 90, each of which connected to a tablet 91 associated with the intermediate portion 36 through the interposition of a hinge 92 for each arm 90. Between each arm 90 and the tablet 91 an elastic member 94, for instance a torsion spring, is arranged, so as to engage the corresponding arm 90 and therefore to give stiffness to the arch 30 as a whole and a given tension to the cable 40. Each spring 94 presents, in particular, a respective end element 95 connected to the tablet 91 and the remaining end element 96 connected to the arm 90. With reference to FIG. 8 again, it should be noted that the end element 96 is connected to the tablet 91 in a fixed and selectively rotatable manner to allow to rotate it axially around the axis of the spring 94 and consequently to set the torque exerted by the spring 94 and definitely the value of the pre-load tension acting on the cable 40. To drive this end element 96 into rotation it is possible to use a regulating device 97, known and only partially illustrated through a respective key 97, which is also known and only partially illustrated. In particular, to each turn or portion of turn of the end element 95 connected to the tablet 91 a given value will correspond of the tension applied to the cable 40 and, consequently, the entity of the force to be exerted on the handle member 34 to perform a given exercise. The stiffness of each of the two arms 90 is therefore adjustable at will, and the cable 40 has also the function to limit the relative angle of rotation of the two arms 90, whose value will depend upon the value of pre-load torque of the two springs 94.

Figure 9:
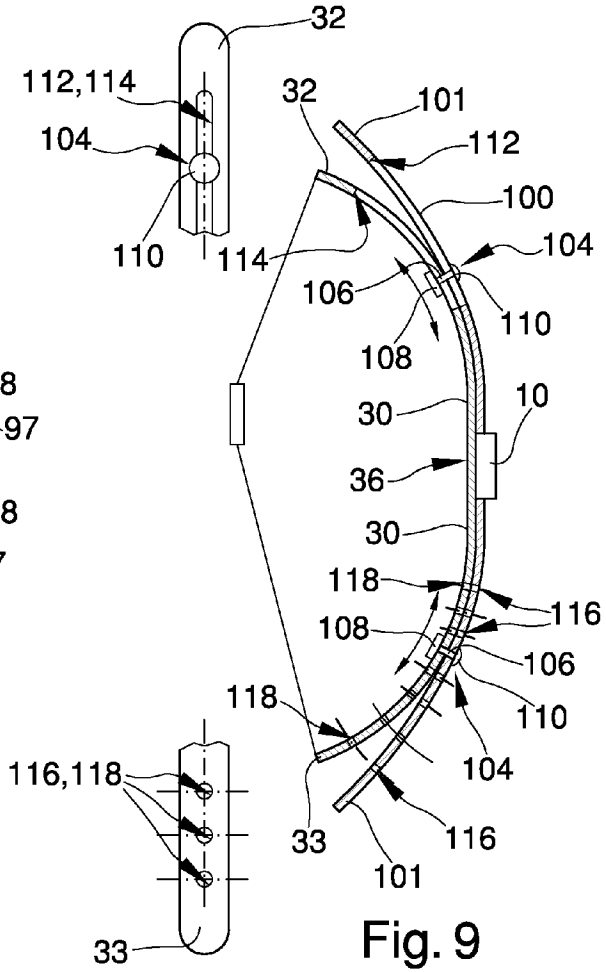
FIG. 9 is a sectional side elevation view of a ninth preferred embodiment of a portion of FIG. 1 in enlarged scale and with some parts removed for the sake of clarity.

With reference to FIG. 9, the gymnastic equipment 1 is modified so that to the arch 30 a leaf spring member 100 is paired, shaped similarly to the arch 30 and stably coupled to the intermediate portion 36 of the arch 30. The leaf spring member 100 in particular presents a pair of arms 101 extending from the intermediate portion 36, and the leaf spring member 100 globally presents longitudinal extension approximating the longitudinal extension of the arch 30. Both the arms 101 of the leaf spring member 100 and the arch 30 are designed to couple transversally to one another. In this regard, the gymnastic equipment 1 is provided with a coupling unit 104 for each arm 101, which comprises a pin 106 delimited by two heads 108 and 110, spaced from each other nearly by the sum of the transverse thicknesses of the arch 30 and of the leaf spring member 100, to connect them transversally in a close manner and therefore to combine the flexural stiffness of the arch 30 and the flexural stiffness of the leaf spring member 100. Obviously, both the arch 30 and the leaf spring member 100 are designed to be transversally engaged by the pin 106 in positions which are definable at will and, for the known mechanical properties of the leaf spring members, chosen to give globally a given tension to the cable 40. Each coupling unit 104 can therefore present a longitudinal slit 112, visible only in the upper portion of FIG. 9 and in the corresponding enlargement at the top left, obtained in the body of each arm 101 of the leaf spring member 100 and a slit 114 for each end portion 32 and 33 of the arch 30. Alternatively, without however loosing generality, the coupling unit 104 can present a plurality of holes 116 obtained in the arms 101, distributed uniformly to face a plurality of holes 118 obtained in the arch 30 at opposite side to the intermediate portion 36, as shown exclusively in the lower portion of FIG. 9 and in the corresponding enlargement at the bottom left. Each pin 106 can be of the modular type with the threaded ends engaged by the heads 108 and 110 through a screw coupling, selectively releasable to adjust the position of the coupling pin 106 between the arch 30 and the leaf spring member 100.

Figure 10:
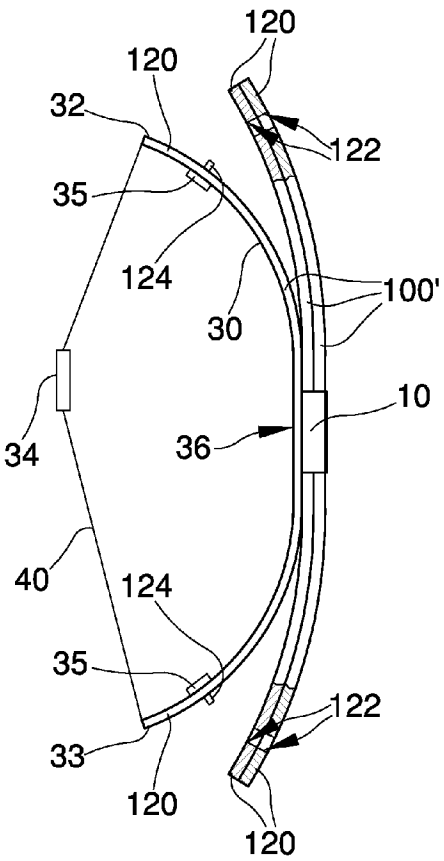
FIG. 10 is a side elevation view of a tenth preferred embodiment of a portion of FIG. 1 in enlarged scale and with some parts removed for the sake of clarity.

Alternatively, again to allow varying the tension of the cable 40 in a simple and economical manner, the gymnastic equipment 1 can present a plurality of leaf spring members 100' carried in a close manner by the frame 10 at opposite side from the cable 40 relative to the arch 30 at the intermediate portion 36 as shown in FIG. 10. Each leaf spring member 100' is delimited by two respective free ends 120, each of which presents, in turn, a through hole 122 and each free end 120 of each leaf spring member 100' is bored so that the holes 122 obtained in a given part relative to the intermediate portion 36 are mutually concentric so as to be coupled by a through pin 124 arranged transversally. The arch 30 presents a through hole 35 for each end portion 32 and 33, arranged in a position which can face the holes 122 and usable to connect the arch 30 to one or more of the leaf spring members 100' through the pin 124 so as to adjust at will the stiffness of the arch 30.

In view of the above description, it is easily understood that the gymnastic equipment 1 described above solves the problem of having available a functional machine which is easy to use, requires limited maintenance and lasts, which can be arranged both indoor or outdoor, also near marine environments, without the need for an accurate maintenance.

What is claimed is:

1. An exercise device (1) comprising:

a frame (10), a load group carried by said frame (10); said load group (20) including an elongated arch-shaped elastic body (30) connected to said frame (10) and a flexible member (40) connected to said arch-shaped elastic body (30); wherein said arch-shaped elastic body (30) includes a first end portion (32) and a second end portion (33), and wherein said flexible member (40) is coupled between said first end portion (32) and said second end portion (33), respectively, so as to maintain said flexible member (40) tensioned both at rest and in use, during the execution of a training exercise;

a coupling means (12) for coupling said frame with an intermediate portion (36) of said arch-shaped elastic body; said coupling means (12) including a base (120) adapted to couple rigidly to a fixed body (P)(W);

wherein said load group includes a handle member (34) associated with said flexible member (40) to facilitate the gripping thereof according to a direction transverse to a longitudinal axis (41) of said flexible member (40), so as to facilitate the application of a tensile stress to said elastic body (30) during the execution of a training exercise;

wherein said intermediate portion (36) of said arch-shaped elastic body is substantially equidistant from said respective end portions (32) (33);

wherein said coupling means (12) includes a guiding member (124) coupled rigidly to said fixed body (P)(W) and a slide (126) coupled to said guiding member (124); wherein said arch-shaped elastic body (30) is connected to said slide (126) for adjusting an arrangement of said arch-shaped elastic body (30) along said guiding member (124); and wherein said arch-shaped elastic body (30) is connected to said slide (126) through a second joint (18) for allowing transverse movements of the arch-shaped elastic body (30) relative to said guiding member (124).

2. An exercise device according to claim 1, wherein said coupling means (12) includes a rod (122) extending from said base (120).

3. An exercise device according to claim 2, wherein said rod (122) is telescopic so as to allow the adjustment of a respective longitudinal extension thereof.

4. An exercise device according to claim 3, further comprising first blocking means (50) adapted to fix a longitudinal extension of said telescopic rod (122); said rod (122) including at least one first element (14) and one second element (14'), elongated and mutually coupled in a longitudinally slidable manner, and including at least one first and one second holes (15)(15') oriented transversally to said rod (122); said first blocking means (50) including at least one first pivot pin (52) adapted to engage said transverse first and second holes (15)(15') to block reciprocally said first element (14) and second element (14') in axial direction.

5. An exercise device according to claim 3, wherein said arch-shaped elastic body (30) is connected to said rod (122) through a first joint (16) adapted to allow transverse movements of said arch-shaped elastic body (30) relative to said rod (122).

6. An exercise device according to claim 1, wherein said coupling means (12) includes an articulated four bar linkage (60) arranged between said arch-shaped elastic body (30) and said guiding member (124) to adjust a distance between said arch-shaped elastic body (30) and said guiding member (124).

7. An exercise device according to claim 1, wherein said guiding member (124) includes at least one elongated cylindrical body (128) oriented according to a direction (D); said slide (126) including a sleeve (127) coupled to said cylindrical body (128) in a freely axially slidable and freely rotatable manner, to rotate, in use, said arch-shaped elastic body (30) relative to said cylindrical body (128).

8. An exercise device according to claim 1, wherein said second joint (18) is of the rotoidal type.

9. An exercise device according to claim 1, wherein said flexible member (40) is substantially non extendable and includes a respective working length (LU) determined by said end portions (32)(33).

10. An exercise device according to claim 1, wherein said flexible member (40) includes a first and a second end (42) (43) stably connected respectively to one of said first and second end portions (32)(33).

11. An exercise device according to claim 9, wherein said flexible member (40) includes at least one third end (42') connected to said arch-shaped elastic body (30) in a slidable manner between said first and second end portions (32)(33) through the use of a carriage (72) coupled to said arch-shaped elastic body (30) in a freely slidable and transversely selectively blockable manner, to allow to vary at will said working length (LU) and the entity of the load acting on said handle (34).

12. An exercise device according to claim 10, wherein said flexible member (40) is connected to said arch-shaped elastic body (30) through the interposition of a winder (80) to allow to vary at will the extension of said working length (LU) of said flexible member (40) and the entity of the load acting on said handle (34).

13. An exercise device according to claim 6, wherein said articulated four bar linkage (60) includes a plurality of levers (62), each of which being coupled to said slide (126) or rotatably to each other two by two through rotoidal pairs (64); at least some of said rotoidal pairs (64) including a blocking unit (66) suitable to fix an inclination of a said lever (62) respective to said slide (126), or of two levers (62) coupled rotatably to each other, in a stable manner.

14. An exercise device according to claim 13, wherein at least one of said blocking units (66) includes an elastic member (68) suitable to exert an adjustable elastic strength, which, in use, contrasts a relative movement of the corresponding coupled members.

15. An exercise device according to claim 1, wherein said arch-shaped elastic body (30) includes a pair of arms (90), each of which is connected to said intermediate portion (36) through a hinge (92); a pair of elastic members (94), each of which is arranged between each said arm (90) and a plate (91) associated to said intermediate portion (36) so as to engage angularly the corresponding said arm (90) and, therefore, to give stiffness to said arch-shaped elastic body (30) as a whole and a given tension to said flexible member (40).

16. An exercise device according to claim 15, wherein each said elastic member (94) includes a torsion spring (94) and wherein the torsion spring (94) includes a respective end element (95) connected to said plate (91) and a further end element (96) connected to the corresponding said arm (90); each said further end element (96) being connected to said plate (91) in a fixed and selectively rotatable manner to allow to rotate each said further end element (96) axially around the axis of the spring (94) to set a torque exerted by said spring (94) and therefore a value of said tension acting on said flexible member (40).

17. An exercise device according to claim 1, further comprising a crossbow-shaped member (100) shaped similarly to said arch-shaped elastic body (30), stably coupled to this latter close to said intermediate portion (36) and including longitudinal extension globally approximating a longitudinal extension of said arch-shaped elastic body (30); said crossbow-shaped member (100) including a pair of arms (101) extending at opposite sides from said intermediate portion (36) and the crossbow-shaped member (100); coupling means (104) being provided to couple transversally said arch-shaped elastic body (30) with said crossbow-shaped member (100).

18. An exercise device according to claim 17, wherein said coupling means (104) includes, for each said arm (101), a pivot pin (106) and is designed to connect transversally in a close manner said arch-shaped elastic body (30) and said crossbow-shaped member (100) in a given position relative to said intermediate portion (36) to combine flexural stiffness of the arch-shaped elastic body and of said crossbow-shaped member (100).

19. An exercise device according to claim 17, further comprising a plurality of crossbow-shaped members (100') carried in a close manner by said frame (10) next to said intermediate portion (36); each said crossbow-shaped member (100') being determined by two respective free ends (120), each of which including a third through hole (122); said third holes (122) obtained at the same side relative to said intermediate portion (36) being mutually concentric so as to be connected by a transverse member (124); said arch-shaped elastic body (30) including, for each said end portion (32)(33), a fourth through hole (35) arranged in a position, which can face said third holes (122), so as to be connected to one or more of the crossbow-shaped members (100') through said transverse member (124) so as to adjust at will a stiffness of said arch-shaped elastic body (30).

* * * * *